US005340036A

United States Patent [19]

Riley

[11] Patent Number: 5,340,036

[45] Date of Patent: Aug. 23, 1994

[54] DRY WASTE GRINDER

[75] Inventor: Wayne C. Riley, Sturtevant, Wis.

[73] Assignee: Emerson Electric Co., Racine, Wis.

[21] Appl. No.: 64,490

[22] Filed: May 19, 1993

[51] Int. Cl.[5] ..... B02C 18/40; B02C 18/42

[52] U.S. Cl. ..... 241/56; 241/57; 241/92

[58] Field of Search ..... 241/46.013, 60, 92, 241/56, 57

[56] References Cited

U.S. PATENT DOCUMENTS

| | | | |
|---|---|---|---|
| 2,495,983 | 1/1950 | Richards | 241/46.013 |
| 2,615,637 | 10/1952 | Bittner . | |
| 2,682,376 | 6/1954 | Frank . | |
| 2,801,803 | 8/1957 | Borman . | |
| 2,816,466 | 12/1957 | Gladfelter et al. . | |
| 2,832,548 | 4/1958 | Hammes . | |
| 2,870,970 | 1/1959 | Williamson | 241/46.013 |
| 2,950,868 | 8/1960 | Lannert . | |
| 3,065,919 | 11/1962 | Burkett et al. . | |
| 3,088,685 | 5/1963 | Bridgewater . | |
| 3,098,515 | 7/1963 | Forsberg . | |
| 3,112,077 | 11/1963 | Yartz . | |
| 3,155,326 | 11/1964 | Rhodes . | |
| 3,756,517 | 9/1973 | Hoch et al. | 241/56 |
| 4,593,863 | 6/1986 | Mordstein et al. | 241/92 |
| 4,637,561 | 1/1987 | Edberg | 241/154 |
| 4,739,937 | 4/1988 | Carpenter, Jr. et al. | 241/791 |
| 5,245,796 | 9/1993 | Rote et al. | 15/339 |

*Primary Examiner*—Mark Rosenbaum
*Assistant Examiner*—John M. Husar
*Attorney, Agent, or Firm*—Ryan, Kees & Hohenfeldt

[57] ABSTRACT

A grinder for dry waste materials includes a vertically-oriented, cylindrically-shaped housing having an opening at its upper end for receiving materials to be comminuted. The shredder element has upwardly-extending impeller blades disposed on its upper surface. The outer perimeter of the shredder element is separated from the inner wall of the housing sufficiently to provide a gap through which comminuted materials can drop from the upper chamber to the lower chamber of the housing. The interior of the upper portion of the housing is provided around its circumference with diverget blades that are angled downwardly in the direction of rotation of the shredder element. The lower housing has a closed bottom and a tangentially oriented discharge element for discharge from the lower housing of comminuted materials. The shredder element has downwardly-extending paddles on its lower surface that extend downwardly into the lower housing and are adapted to sweep the lower housing, act as an air blower and expel comminuted materials therefrom. Optionally the shredder element is flattened on opposite sides, to provide enlarged openings for movement of comminuted materials from the upper chamber into the lower chamber. The upwardly-extending impeller blades may optionally be Z-shaped.

8 Claims, 3 Drawing Sheets

DRY WASTE GRINDER

FIELD OF THE INVENTION

This invention relates to apparatus for grinding waste materials. More specifically, the invention relates to waste grinders for materials such as foods, medical waste, or other materials such as foam plastics that can be ground or comminuted and then disposed of without the need of washing the ground materials away by means of a supply of flushing water.

BACKGROUND ART

Food waste disposers in sinks and other types of waste grinding devices are commonly used with a supply of flushing water that transports the ground material through a drainage pipe into a waste disposal system. Because of clogging problems, such disposers have generally not been operated without water. However, many wastes can more efficiently be recovered, recycled, or disposed of if they are maintained in a dry state. For example, in the case of food waste converted to use as animal feed, it is desirable to eliminate the need for energy consuming drying processes. A need has, thus, existed for devices that are capable of conserving water and providing a disposal means that results in a dry waste material that does not have to be flushed through a sanitary waste treatment system.

SUMMARY OF THE INVENTION

The present invention has as its principal object the provision of a workable dry waste grinder. In accordance with one aspect of the invention, waste food, for example, such as is generated by fast food restaurants, can be ground up in a dry state and retained in such a state for use as animal or poultry food. Such materials can be ground in accordance with the present invention and subsequently dried to an even lower moisture level in order to stabilize the product and thereby prevent spoilage.

In accordance with another aspect of the invention, medical waste such as plastics, sticks and needles can be ground into a finely comminuted, or pulverized, material that can safely be disposed of while reducing the hazards usually associated with the disposal of such materials. In accordance with yet another aspect of the invention, waste materials such as foam, plastics, or other light-weight materials can be successfully ground up into small particles for either disposal or recycling.

In accordance with an important aspect of the invention, a rotating shredder element is provided with shredder/impeller components shaped for optimum handling of the particular materials to be disposed of. The rotating shredder elements work in combination with stationary angled diverter blades mounted around the rotating component in a stationary housing. The diverter blades are angled downwardly so as to transfer the centrifugal force imparted to the material by the rotating element into a downward force that moves the material through the rotating, cutting elements. In accordance with a related aspect, the downwardly angled blades produce a means for moving the material through the cutting elements without the need for using water as a carrier material.

In accordance with a yet further aspect of the invention, the rotating component is provided with paddles, or extensions, on its bottom surface that move the processed material out of a lower housing of the device outward through a discharge port.

In a yet further related aspect of the invention, the discharge opening is shaped in the form of a tangential area extending off of one side of the cylindrical lower housing area so that the motion imparted to the comminuted material by the rotating paddles effectively blows the comminuted material out of the lower housing.

In accordance with a further, optional, aspect of the invention the rotating components are provided with flat areas on opposite sides in order to provide an enlarged port for passage of waste material as it is comminuted to pass from the cutting elements into the discharge area. In accordance with a still further related aspect, the size and shape of the flat areas enable careful control of particle size of the comminuted material as well as control of the speed of grinding.

Briefly summarized, the invention provides a grinder for dry waste materials that includes a vertically-oriented, cylindrically-shaped housing having an opening at its upper end for receiving materials to be ground or comminuted. The housing is divided into upper and lower chambers by means of a rotatable, disk-shaped shredder element. The shredder element has upwardly-extending impeller blades disposed on its upper surface. The outer perimeter of the shredder element is separated from the inner wall of the housing sufficiently to provide a gap through which comminuted materials can drop from the upper chamber to the lower chamber of the housing. The interior of the upper portion of the housing is provided around its circumference with diverger blades that are angled downwardly in the direction of rotation of the shredder element. The lower housing has a closed bottom and a tangentially oriented discharge element for discharge from the lower housing of comminuted materials. The shredder element has downwardly-extending blades on its lower surface that extend downwardly into the lower housing and are adapted to sweep the lower housing and expel comminuted materials therefrom outwardly through the tangential opening. The shredder element is connected by a central shaft to a means such as an electric motor to rotate the element. In accordance with one embodiment of the invention, the shredder element is flattened on at least one side, and preferably on both sides, to provide enlarged openings for movement of comminuted materials from the upper chamber into the lower chamber. The enlarged opening is preferably in the form of a flattened side on the disk-shaped element and is preferably located at the point where an upwardly-extending impeller blade intersects the circumference of the rotating shredder. Preferably the paddles on the bottom of the shredder element occupy a sufficient portion of the cross-section of the lower housing so that upon rotation the paddles act as a blower, capable of moving air out of the discharge opening and drawing air down through the inlet into the disposer.

In accordance with yet another embodiment of the invention, the upwardly-extending impeller blades are provided with upper surfaces extending forwardly in the direction of rotation. The edges are preferably provided by use of Z-shaped brackets attached to the upper surface of the shredder element.

The invention will further be explained in the following detailed description and accompanying drawings wherein:

DRAWINGS

FIG. 1 is the side elevational view of a grinder in accordance with the present invention with parts broken away in the cross-section and with other parts shown by phantom lines for purposes of illustration, FIG. 2 is a cross-sectional view taken along line 2—2 of FIG. 1, FIG. 3 is a perspective view of a rotational shredder component of a grinder of the present invention, FIG. 4 is a cross-sectional view taken along line 4—4 of FIG. 1, showing both the shredder component and the lower housing, FIG. 5 is a side elevational fragmentary cross-sectional view of a grinder in accordance with a further embodiment of the invention, FIG. 6 is a perspective view of a rotational component of a grinder in accordance with a further embodiment of the invention, FIG. 7 is a perspective view of a rotational component of a grinder in accordance with the embodiment shown in FIG. 5; and, FIG. 8 is a cross-sectional view taken along line 8—8 of FIG. 5.

DETAILED DESCRIPTION

Referring specifically to the drawings, there is shown a grinder generally indicated by numeral 10. Grinder 10 can be mounted in conventional fashion in a sink opening 12. Grinder 10 includes an upper throat portion 14 for receiving materials to be ground as they are discharged through the opening in sink 12.

Figure 4:
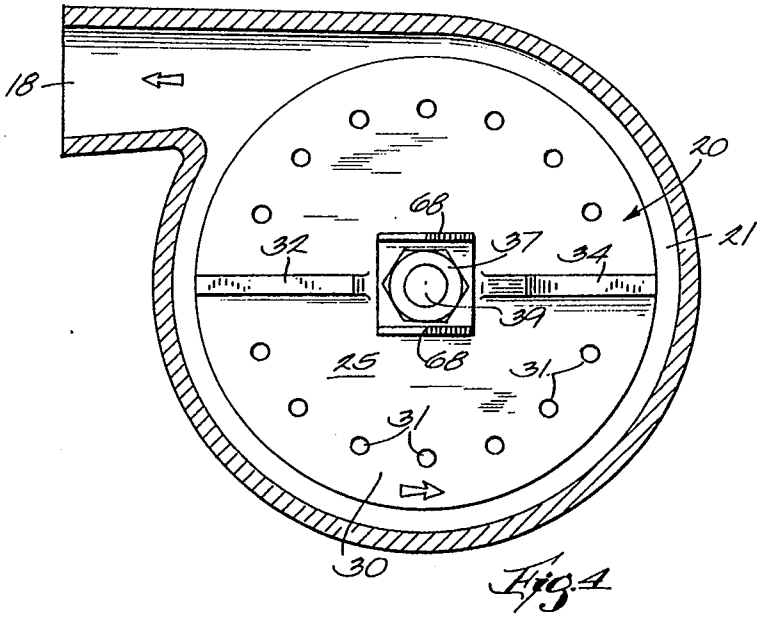
Figure 1:
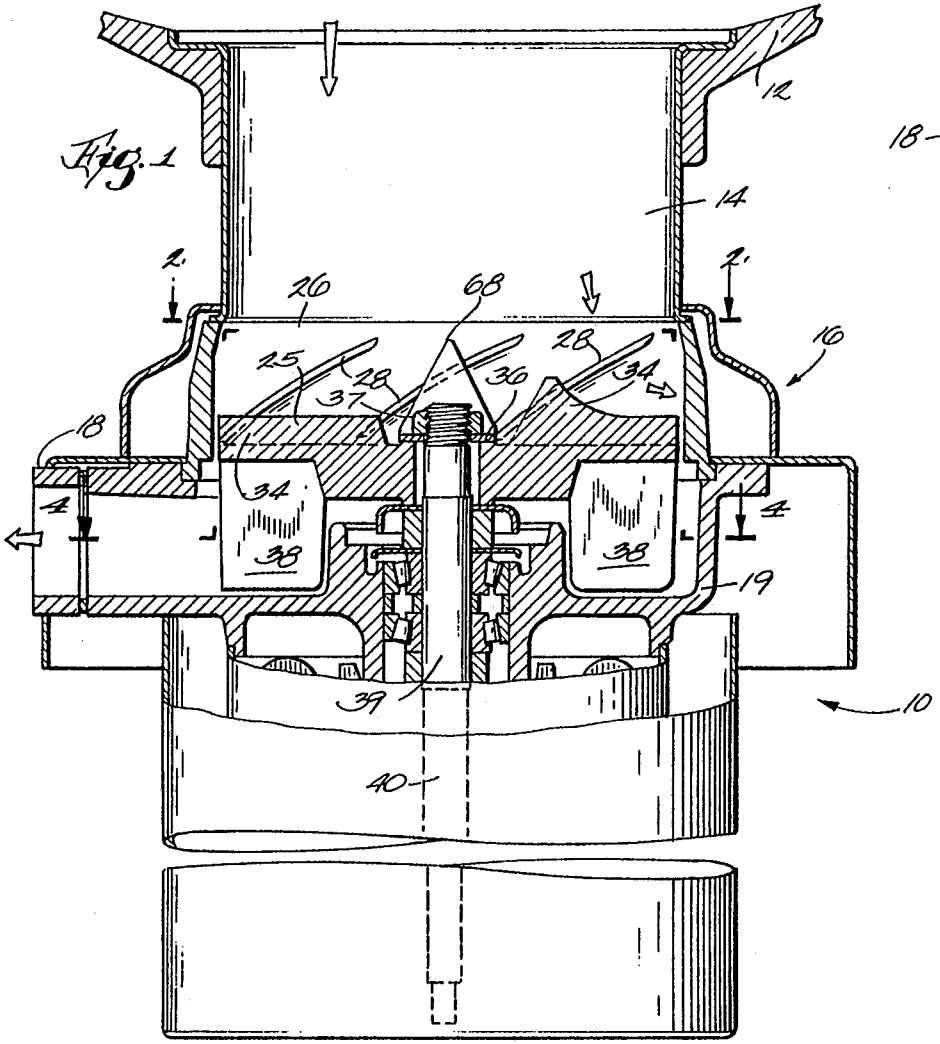

Grinder 10 includes an upper grinding section 16. A discharge opening 18 of a tangential shape as seen in FIG. 4 is provided in a lower housing 19 from which materials are discharged after grinding.

Figure 3:
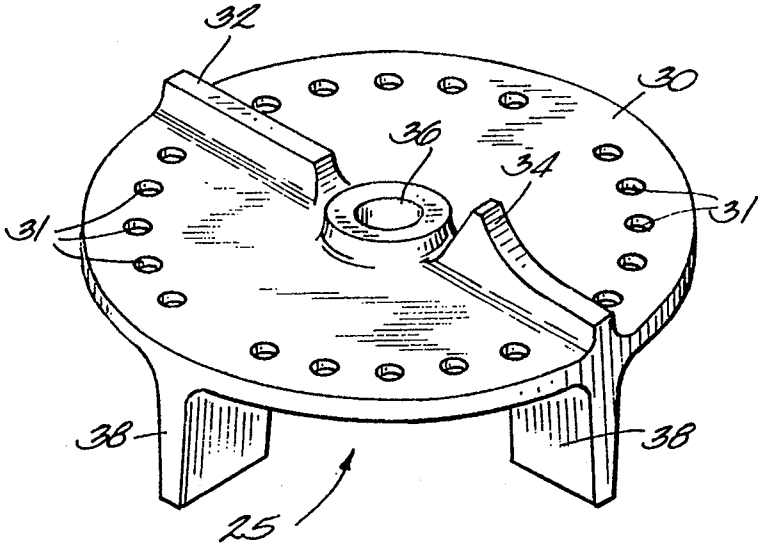
Figure 2:
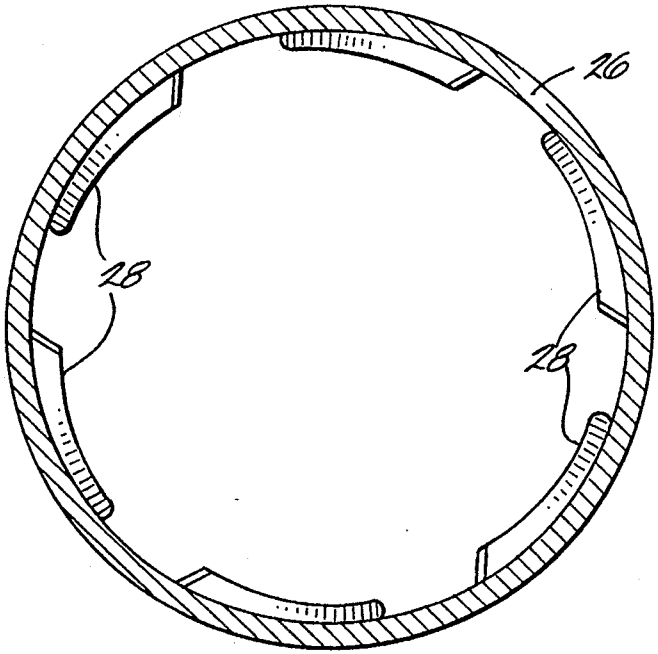
Figure 5:
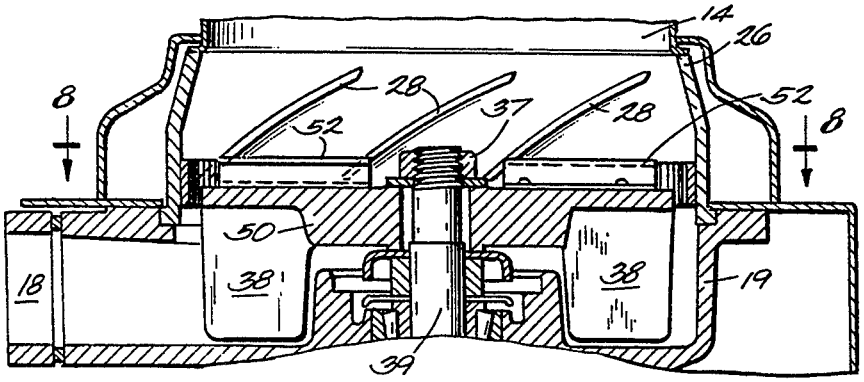

A rotatable shredder component 20 divides the grinding section 16 of the grinder from the discharge section 19. A gap 21 between the upper and lower housings allows material to fall from the grinding chamber 16 into the lower housing 19. Surrounding the grinding chamber 16 is a cylindrical enclosure 26 that is provided on its inner surfaces with spaced angled diverter blades 28. Blades 28 are angled so that materials thrown against them by centrifugal forces of the rotating component 20 are converted into downwardly angled forces that impel those materials which are ground to a small enough particle size through gap 21 into lower chamber 19. One form of rotatable component is shown in FIG. 3 and indicated generally by numeral 25. Impeller component 25 includes a flat plate portion 30 that may be provided with circular openings 31 around its perimeter. Extending upwardly from plate portion 30 are impeller blades 32 and 34. These blades may be provided with different shapes as required in order to cause particles of differing sizes or densities to be impelled by centrifugal forces as the impeller component 25 is rotated. A cylindrical central opening 36 is provided for mounting of the rotatable element in the housing by means of a nut 37 that can be threadably received on a shaft 39. Holes 31 provide a means for additional air, as well as finely divided particles, to enter the lower chamber and eventually out the discharge.

In order to provide a means to expel the ground particles from the lower housing, the rotatable component 25 is provided with spaced paddle elements 38 that sweep the majority of the cross-sectional area of housing 19 as component 25 is rotated. Shaft 39 is connected to a spindle 40 that is rotationally driven by an electric motor (not shown) in accordance with conventional practice.

A shredder element 25 of the configuration shown in FIG. 3 has been found to work well with food wastes, for example, of the type generally produced in fast food restaurants. The use of such grinder material can be ground up or reduced in size and collected by discharging the material into a container. A sewer drain line is not required, and the waste material is not contaminated with water. The waste disposer can, thus, be used in installations where existing facilities or regulatory codes prevent the discharge of food waste into the sewer system. The food waste can also be further processed without the problems imparted by the addition of the bulk and weight of water in the waste. The food waste may be further processed by means of a dryer to remove remaining moisture in order to retard spoilage during storage and to provide material that can be processed into animal feed or, for example, used for composting.

Figure 6:
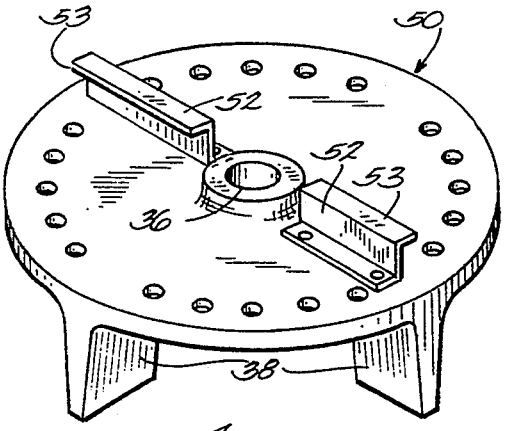

Referring to FIG. 6, there is shown an alternative form of shredder element 50. Shredder element 50 is similar to shredder element 25 with the exception of the form of the impeller blades 52. As seen in FIG. 6, the impeller blades 52 are of a Z-shaped configuration. The top edges 53 of blades 52 are horizontally-oriented and extend in the direction in which shredder element 50 rotates. It will be understood that these blades could, alternatively, be of a capital "C" shape instead. The Z-shaped brackets of FIG. 6 have been found to be particularly effective for dry grinding of solid materials, for example, medical wastes such as those made of plastic, metal, or cloth including needles, tubing, or the like. The Z-shaped brackets 52 increase the effectiveness of the shredder element in catching particles of material to be comminuted and blowing the same along the length of the Z-shaped blade by means of centrifugal force and, then, forcefully impacting the same against diverter blades 28. The Z-shaped brackets have been found beneficial in reducing bouncing of hard materials off of the surface of upper chamber 26. Grinding speed has been found to be improved in the additional centrifugal, or side force, and has been found to aid in the grinding and size reduction. The force of the materials moving along the blades keeps the stationary shredder piece clean by continuous blasting of these teeth by the particles of material. These Z-shaped brackets have also been found to be helpful in dry-grinding of sticky or damp materials such as certain food wastes.

Figure 7:
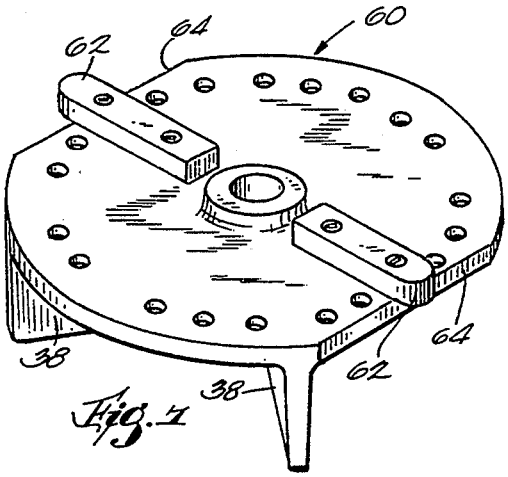
Figure 8:
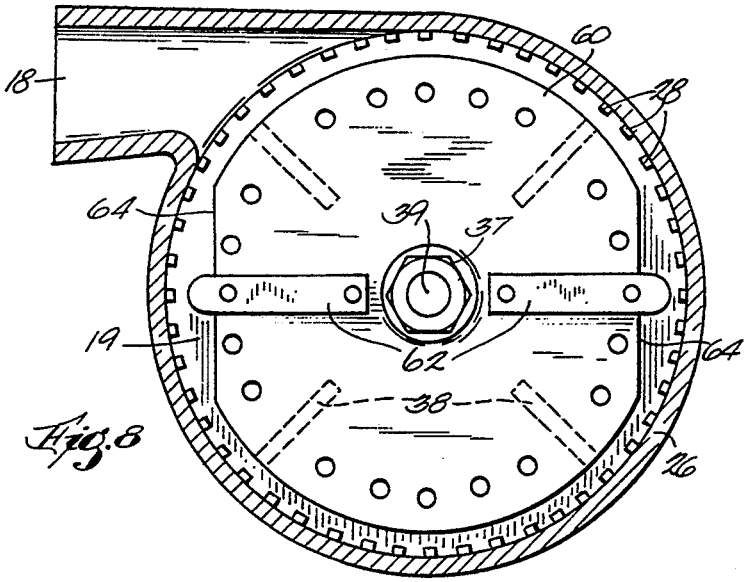

A still further embodiment of the invention is seen is FIGS. 7 and 8. A further form of shredder unit 60 is provided with outwardly extending blades or lugs 62. The opposed sides of shredder element 60 are provided with flat or cutout areas 64. As seen in the drawings, these flat areas are preferably aligned so they are centered at the point at which blades 62 intersect the circumference of shredder element 60. As best seen in FIG. 8, the flat areas 64 provide an enlarged opening for materials to drop from upper chamber of the grinder 26 into lower chamber 19. It is particularly desirable to provide such enlarged openings when lightweight materials such as foamed plastics are comminuted. Such materials are more easily stored and transported, for example, for recycling when ground into smaller particles. Blades 68 can also be attached to shaft 39 in order to break materials such as polystyrene foam or similar bulky materials into smaller sections to allow faster grinding. In the illustrated embodiment these blades 68 are formed on opposite ends of a U-shaped bracket held in place by nut 37.

Paddles or impeller blades 38 at the bottom of the rotating shredder element serve to expel materials from the lower chamber out through opening 18 and also act as a blower. The rotating paddles are capable of moving a large amount of air out of discharge 18 and, thus, draw air through inlet portion 14 of the grinder. The resulting negative air pressure at the inlet helps in drawing fumes and dust into and through the disposer. This provides a safer environment for the operator of the grinding equipment if odorous or hazardous materials are being ground. Such action is particularly important in the case of light-weight materials such as foam plastics which could otherwise tend to float upward out of the inlet when the grinder is turned on.

Diverter blades 28 can be made out of differing materials depending on the type of use that the grinder is intended for. For example, diverter blades made of stainless steel with somewhat rounder edges can be used for comminution of soft materials such as fast food waste, vegetable waste, and foam plastics. A harder-cast tool steel with sharpened edges is, however, desirable when the grinder is intended for use with the comminution of harder materials such as hard plastic, paper, or bone. The size and shape of gap 21 and flat area 64 control the grinding performance such as speed of grind and particle size of comminuted material. In general, increasing the size of flattened area 64 increases the speed of grind and also increases the particle sizes. Fast grind speeds are desirable for lighter materials such as foam plastics, while heavy objects, such as hard plastics, or heavy foods require slower grinding speeds in order to avoid motor over-loading or blockage of the outlet.

While specific embodiments of the invention have been shown for purposes of illustration, it will be understood that the scope of the invention is limited only by the following claims.

What is claimed is:

1. A grinder for dry waste materials comprising:

a vertically-oriented, cylindrically-shaped housing having an opening at its upper end for receiving materials to be comminuted, said housing being divided into upper and lower chambers by means of a rotatable, disk-shaped shredder element, said shredder element having upwardly-extending impeller blades disposed on its upper surface, the outer perimeter of said shredder element being separated from the inner wall of said housing sufficiently to provide a gap through which comminuted materials can drop into said lower chamber, diverter bladed uniformly spaced around the inner perimeter of said upper portion of said housing and being angled downwardly in the direction of rotation of said disk-shaped shredder element, said lower chamber having a closed bottom and a discharge outlet for discharge therefrom of comminuted materials, said discharge outlet being tangentially oriented relative to the circumference of said cylindrically-shaped lower chamber, said shredder element having downwardly extending blades on its lower surface, said blades having an area adapted to sweep said lower chamber and expel comminuted materials therefrom outwardly through said tangential opening, said shredder element being connected by a central shaft to a means to rotate said element.

2. A grinder according to claim 1 wherein said shredder element is flattened on at least one side of its periphery to provide an enlarged opening for movement of comminuted materials into said lower chamber.

3. A grinder according to claim 2 wherein the enlarged area comprises a flat area located at the point where an upwardly-extending blade intersects the circumference of the rotating shredder.

4. A grinder according to claim 3 wherein said blade extends outwardly and overhang the edge of said flat area.

5. A grinder according to claim 1 wherein said upwardly-extending impeller blades are provided with upper edges extending forwardly in the direction of rotation.

6. A grinder according to claim 1 wherein the paddles on the bottom of said rotatable shredder element occupy a sufficient portion of the cross-section of said lower chamber so that upon rotation they act as a blower capable of moving air out of the discharge opening and drawing air down through the inlet into the disposer.

7. A grinder according to claim 1 wherein said impeller blades comprise Z-shaped brackets.

8. A grinder for dry waste materials comprising:

a vertically-oriented, cylindrically-shaped housing having an opening at its upper end for receiving materials to be comminuted, said housing being divided into upper and lower chambers by means of a rotatable, disk-shaped shredder element, said shredder element having upwardly-extending Z-shaped impeller blades disposed on its upper surface, the outer perimeter of said shredder element being separated from the inner wall of said housing sufficiently to provide a gap through which comminuted materials can drop into said lower chamber, said shredder element being further provided with a plurality of openings to permit flow of air and finely divided particles to flow from said upper chamber to said lower chamber, diverter blades uniformly spaced around the inner perimeter of said upper portion of said housing and being angled downwardly in the direction of rotation of said disk-shaped shredder element, said lower chamber having a closed bottom and a discharge outlet for discharge therefrom of comminuted materials, said discharge outlet being tangentially oriented relative to the circumference of said cylindrically-shaped lower chamber, said shredder element having downwardly extending blades on its lower surface, said blades having an area adapted to sweep said lower camber and expel comminuted materials therefrom outwardly through said tangential opening, said shredder element being connected by a central shaft to a means to rotate said element.

* * * * *

UNITED STATES PATENT AND TRADEMARK OFFICE

CERTIFICATE OF CORRECTION

PATENT NO. : 5,340,036

DATED : August 23, 1994

INVENTOR(S) : Wayne C. Riley

It is certified that error appears in the above-identified patent and that said Letters Patent is hereby corrected as shown below:

Column 5, Claim 1, Line 54: After "diverter", "bladed" should be deleted and " blades" should be inserted.

Signed and Sealed this

Sixteenth Day of May, 1995

*Attest:*

BRUCE LEHMAN

*Attesting Officer*

*Commissioner of Patents and Trademarks*